United States Patent [19]

Lohmann et al.

[11] 4,265,615

[45] May 5, 1981

[54] FUEL INJECTION SYSTEM FOR LOW EMISSION BURNERS

[75] Inventors: Robert P. Lohmann, South Windsor; Stanley J. Markowski, East Hartford, both of Conn.

[73] Assignee: United Technologies Corporation, Hartford, Conn.

[21] Appl. No.: 968,652

[22] Filed: Dec. 11, 1978

[51] Int. Cl.[3] ..... F23D 15/02

[52] U.S. Cl. ..... 431/353; 431/158; 431/284; 60/746; 60/748

[58] Field of Search ..... 431/352, 353, 284, 158; 60/39.74 B, 39.65, 39.69

[56] References Cited

U.S. PATENT DOCUMENTS

| | | | |
|---|---|---|---|
| 2,398,654 | 4/1946 | Lubbock et al. | 431/352 |
| 2,959,003 | 11/1960 | Carlisle et al. | 431/284 |
| 3,048,014 | 8/1962 | Schmidt | 60/39.65 |
| 3,082,603 | 3/1963 | Hering et al. | 60/39.65 |
| 3,175,361 | 3/1965 | Schirmer et al. | 60/39.69 |
| 3,576,384 | 4/1971 | Peczeli | 431/353 |
| 3,630,024 | 12/1971 | Hopkins | 60/39.74 B |
| 3,998,581 | 12/1976 | Hemingway et al. | 431/352 |
| 4,006,589 | 2/1977 | Schirmer | 60/39.65 |
| 4,062,182 | 12/1977 | Fehler et al. | 60/39.65 |
| 4,173,118 | 11/1979 | Kawaguchi | 431/352 |

FOREIGN PATENT DOCUMENTS

| | | | |
|---|---|---|---|
| 2636520 | 2/1978 | Fed. Rep. of Germany | 60/752 |
| 1024775 | 4/1966 | United Kingdom | 431/352 |

*Primary Examiner*—Joseph Man-Fu Moy
*Attorney, Agent, or Firm*—Charles A. Warren

[57] ABSTRACT

A fuel injection system for low emission burners in which the primary fuel is delivered in an annular spray into the primary combustion zone; at high power operation, secondary fuel is injected additionally in a low angle axial spray to penetrate beyond the primary zone and into the secondary combustion zone downstream of the primary zone.

10 Claims, 6 Drawing Figures

FUEL INJECTION SYSTEM FOR LOW EMISSION BURNERS

BACKGROUND OF THE INVENTION

To minimize the undesirable emissions at both low and high power operations of gas turbine power plants, it has been desirable to maintain control of equivalence ratio of the combustion process throughout the entire range of operation of the burner. When fuel is conventionally injected by the single nozzle constructions and this equivalence ratio is optimized at about unity for minimum emissions of carbon monoxide and unburned hydrocarbons at low powers, it may at high powers become as high as from 1.5 to 2.0. This situation leads to high emissions of both NOx and smoke at high powers.

Although alternative fuel nozzle arrangements have been used, the constructions generally have been directed toward improving the mixing close to the nozzle to obtain a high degree of fuel-air blending close to the nozzle in the hope of promoting cleaner and more complete combustion. These approaches lead to more complex combustors and fuel systems without significant reduction in the objectionable emissions. Multiple stage combustors such as that described in U.S. Pat. No. 3,872,664 have been proposed, in which combustion occurs in two or more discrete zones, in an attempt to achieve optimum equivalence ratio over the entire operating range. However, these concepts generally lead to the use of a multiplicity of fuel injector systems located in different positions.

SUMMARY OF THE INVENTION

The present invention is intended to distribute the fuel within the combustor in order to create primary and secondary combustion zones and to maintain optimum combustion zone equivalence ratios throughout the combustion zones at any power of engine operation. This is done without resorting to multiple location of the fuel nozzles or utilizing elaborate staging arrangements.

A feature of the invention is the injection of the primary fuel mixed with all or part of the primary combustion air in an annulus and at a steep angle to the burner axis into a primary combustion zone and additional injection of secondary fuel in an axially directed low angle spray downstream into a secondary combustion zone. Burning of this fuel, which is injected only at higher power operation will occur where there is an adequate supply of air for complete clean combustion.

According to the invention, the primary fuel, which is continually injected during engine operation at any power setting, is delivered into the primary combustion zone at an acute angle to the axis of the burner and near the inlet to the burner to cause ignition and combustion of this fuel in the primary zone where the mixture of fuel and air will provide the optimum equivalence ratio over the entire range of engine operation. At low power levels, such as idle operation, this optimum equivalence ratio would be about unity to minimize the emissions of carbon monoxide and unburned hydrocarbons. When operating at higher powers above the range of the primary fuel nozzles, additional or secondary fuel is injected downstream of the primary nozzle in an axially directed, small-angle, high velocity stream such that the greater part of this secondary fuel mixes with air in a secondary combustion zone in such a manner as to also maintain, for this secondary zone, the optimum equivalence ratio over the higher powers at which secondary fuel is injected.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

The invention is adapted for use in a burner so constructed as to have a primary combustion zone generally near the upstream end of the burner and a secondary combustion zone downstream of the primary zone. Generally air for combustion in the primary zone is supplied through air inlet holes in the wall of the burner and also in swirler air introduced through the nozzle to mix with the fuel. Additional air inlet holes in the burner wall admit secondary air for combustion with the secondary fuel. Although the nozzle construction shown and described are adapted for use in conventional annular burners or can type burners they are also adapted for the more recently developed high performance burners in which there is a throat section between the primary and secondary zones. The invention will be described as applied to this high performance burner. One example of this type of burner is shown in the Markowski et al U.S. Pat. No. 3,973,395.

Figure 1:
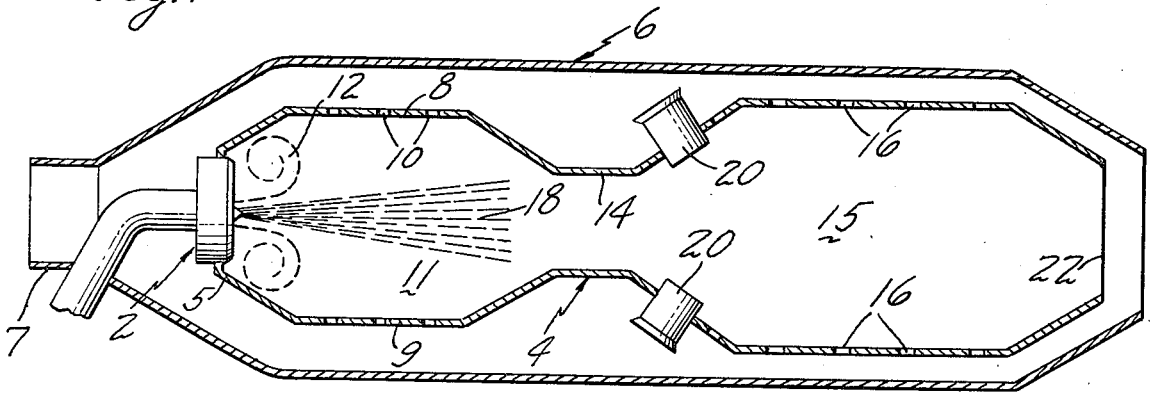
FIG. 1 is a sectional view through a burner construction embodying the invention.

Referring first to FIG. 1, the fuel injector 2 is shown as applied to a burner 4 having an upstream end cap 5 in which the injector is positioned. This burner is located within a combustion chamber duct 6. This duct 6 has an inlet end 7 which receives air under pressure as from a gas compressor and from this inlet end of the duct diverges to form a diffuser so that the air pressure is increased at and downstream of the end cap 5.

The end cap 5 and the opposite side walls 8 and 9 adjacent thereto forming the burner have openings 10 therein for the introduction of primary air into the primary combustion zone 11. Primary fuel is injected from the nozzle in an annular spray 12 closely adjacent to the upstream end of the burner and this spray is at a relatively large angle to the longitudinal axis of the burner as shown. Air under pressure enters the inlet end of duct 7 upstream of the end cap and flows around the burner 4, with a part of the air entering the holes 10 for combustion with fuel within the burner.

The downstream end of the primary zone is defined by a throat 14 defined by the converging inner and outer walls 8 and 9 of the burner at this point. The secondary zone 15 of the burner is downstream of the throat where the side walls 8 and 9 diverge again, and this zone has air inlet openings 16 in both inner and outer walls to support combustion in this zone. The secondary fuel is supplied to this zone as an axially directed small angle spray 18 of fuel, preferably at such an angle that all of the fuel will pass through the throat without impinging on the walls creating the throat. In this way it is possible to maintain the desired equivalence ratio in both zones. If desired the upstream end of the secondary zone may have air swirler inlets 20 therein to create additional turbulence where the fuel and the products of combustion from the primary zone pass through the throat. From the secondary zone the products of combustion and any excess air discharge through the outlet 22 to the turbine, not shown.

Figure 2:
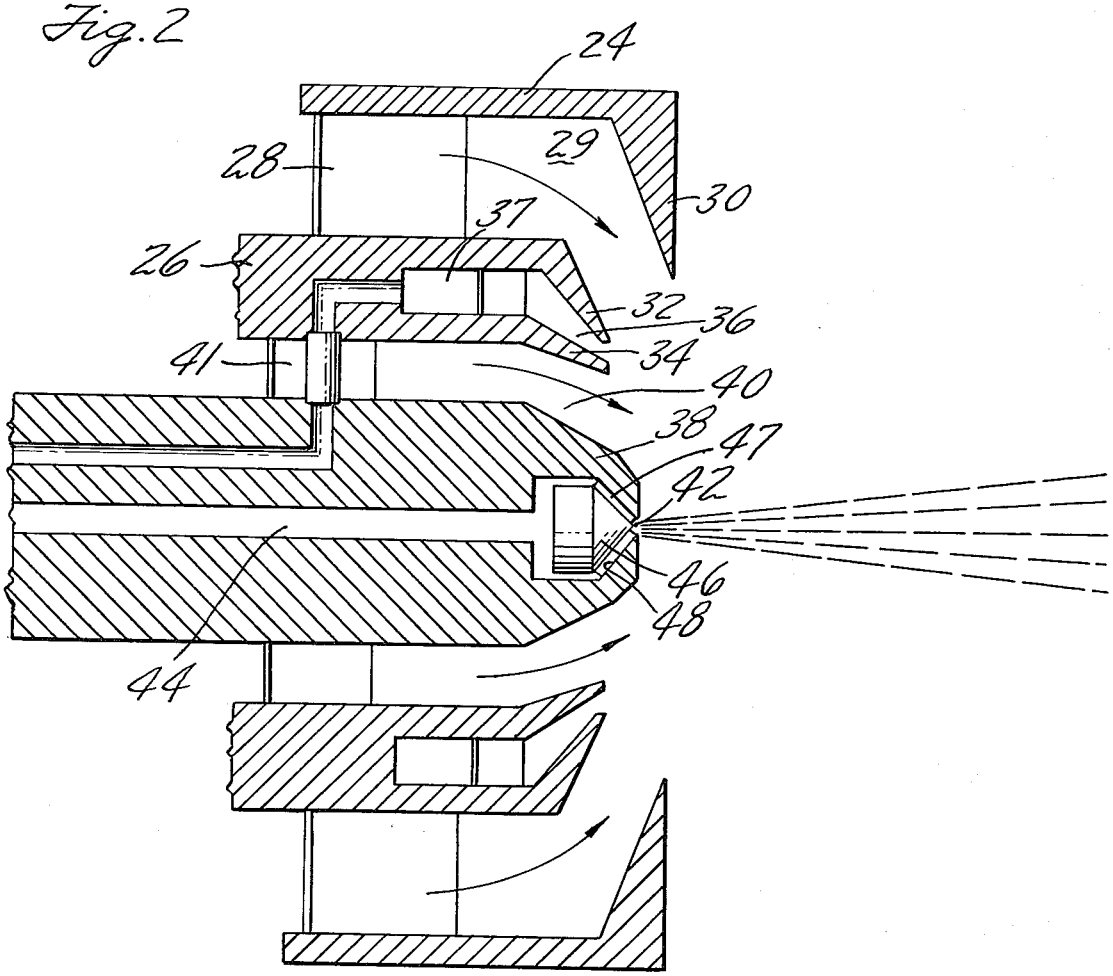
FIG. 2 is a sectional view through the nozzle of FIG. 1.

As shown in FIG. 2, the fuel nozzle is arranged to mix the primary fuel with swirling air for discharge into the combustor. The upper end of the burner receives a sleeve 24 spaced from a housing 26 by air swirler vanes 28 defining a passage 29. The swirling air in this passage 29 is directed inwardly toward the nozzle axis as it leaves the vanes by an inturned lower edge 30 on the sleeve 24. The housing 26 has two concentric conical flanges 32 and 34 defining between them a discharge nozzle 36 for fuel from a supply chamber 37. Radially inward of the inner flange 34 is a secondary nozzle housing 38 defining another annular air path 40 with swirl vanes 41 therein and from which swirling air at the discharge end is also directed inwardly by the shape of the flange 34. Obviously the fuel stream between the flanges 32 and 34 is also directed inwardly by the conical flanges to mix with air flowing from path 40. As the fuel mixes with and is atomized by air from path 40 it is picked up by the swirling air from passage 29 and is caused by the centrifugal force resulting from the swirl to flow outwardly away from the axis of the nozzle forming a toroidal recirculation of air and fuel in the upper end of the primary zone with burning taking place here and further downstream in the primary zone until the primary fuel is completely burned.

The secondary nozzle housing has a central downstream nozzle opening 42 to which fuel may be supplied as by a passage 44. This nozzle construction may have a conical plug 46 therein with slots 47 on its face in contact with a conical surface 48 terminating in the nozzle opening 42. The slots 47 in the plug are arranged to cause the fuel to swirl against the conical surface and this combined with the pressure drop across the nozzle establishes a fuel spray extending axially of the burner and of such a diameter as to pass through the throat and with adequate velocity to enter the secondary zone before any significant portion is burned. Control of the axial spacing of the throat from the nozzle will minimize the quantity of secondary fuel burning before it reaches the secondary zone. In this way the equivalence ratio is not detrimentally affected in the primary zone by the secondary fuel. This type of swirl nozzle is a conventional type of atomizing nozzle.

The effect of this arrangement is to separate significantly the combustion in the primary zone which occurs during all operation of the engine but which is varied according to power demand over the lower part of the power range. With the combustion of the primary fuel occurring in the primary zone but not affected by the secondary fuel it is possible to maintain the desired equivalence ratio in this area.

Since the primary mixing of fuel and combustion air is in a torus surrounding the stream of secondary fuel, and out of line of the secondary fuel which is introduced over the higher range of engine operation, this primary combustion does not significantly affect the discharge of the secondary fuel into the secondary zone so that the secondary fuel reaches the secondary zone where the equivalence ratio is within the desired range.

Figure 3:
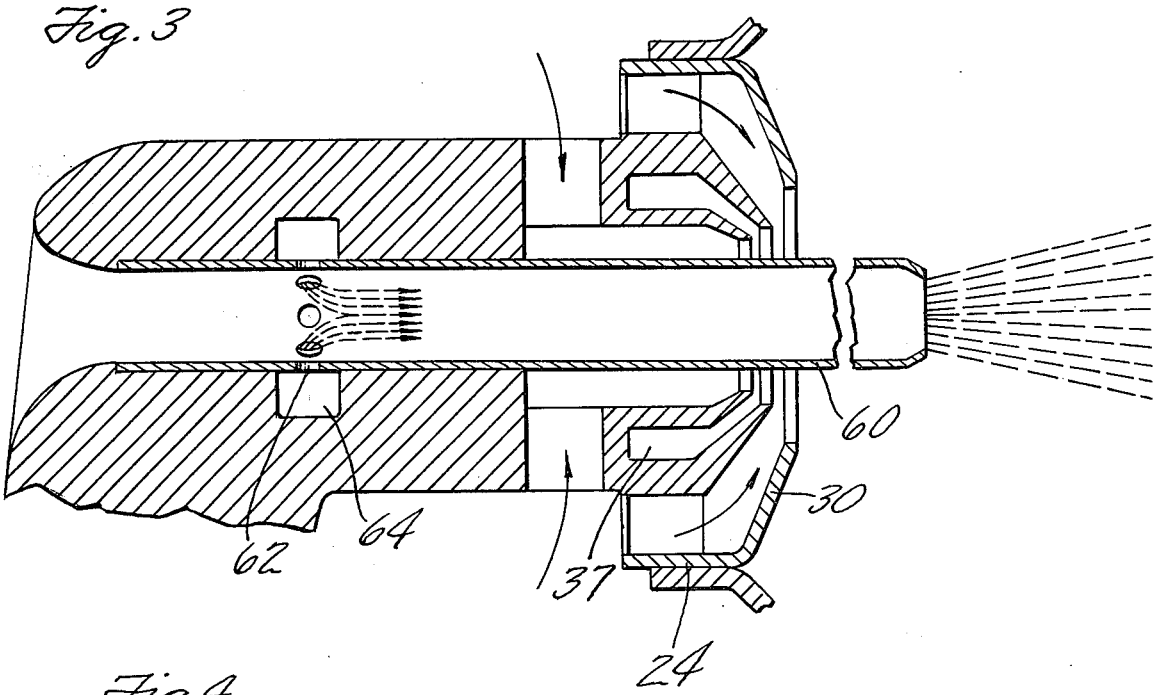
FIG. 3 is a sectional view similar to FIG. 2 through a modified nozzle.

Instead of utilizing the pressure atomized secondary fuel nozzle of FIG. 2, the high velocity stream of secondary air and fuel may be produced as shown in FIG. 3. In this figure the secondary nozzle housing 38 of FIG. 2 is replaced by an axial tube 60 open at its upstream end to ram air from the diffuser upstream of the burner. This air, delivered from the compressor has a high velocity, and the secondary fuel is discharged into this tube through holes 62 in the tube from a chamber 64 surrounding the tube. The rapidly moving air causes at least partial atomization of the fuel and the mixture of secondary fuel and air is discharged through the torus of burning primary air and fuel and discharges through the throat, FIG. 1, into the secondary conbustor zone. The primary nozzle structure of this figure is the same as that of FIG. 2 and similar reference characters are used.

In this arrangement, the tube 60 extends beyond the primary nozzle, as shown, thereby shielding the stream of secondary air and fuel from the primary combustion and placing the end of the tube nearer the throat. Another benefit is that the fuel and air mixture in the tube is shielded by the tube from the heat of the surrounding primary combustion. It will be understood that the tube may end in the plane of the primary nozzle if desired depending upon the configuration of the burner. Desirably, the tube extends far enough into the primary zone to assure delivery of the fuel and air mixture from the tube into the secondary combustion zone before combustion occurs. Similarly the secondary nozzle of FIG. 2 may extend into the burner in the manner of the tube of FIG. 3.

Figure 4:
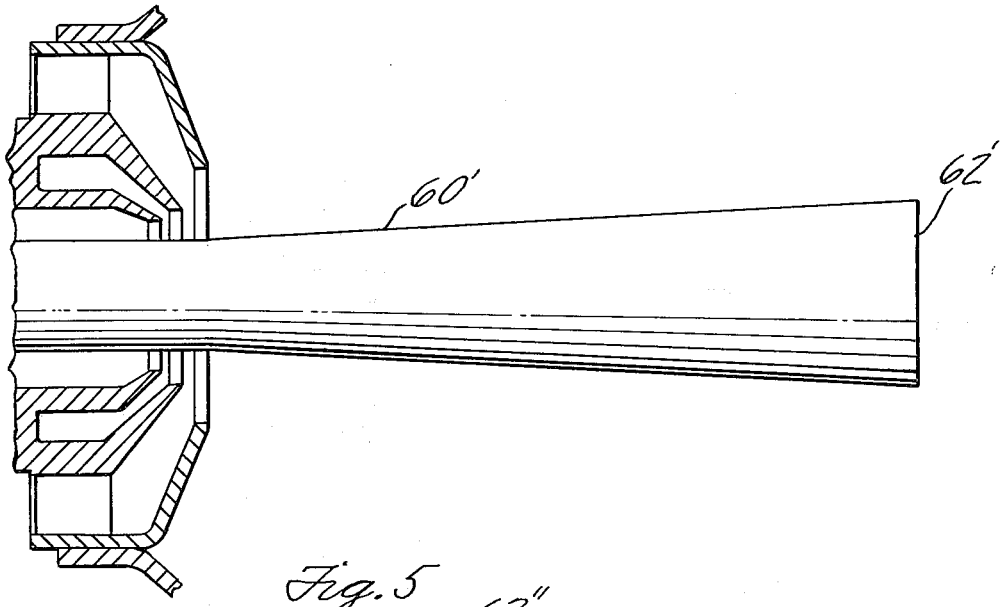
FIG. 4 is a sectional view through a modified tube of FIG. 3.

In FIG. 4 the tube 60' comparable to the tube 60 of FIG. 3 is flared or conical, increasing in diameter toward the downstream end. Where the burner is the can type so that the throat is circular, the tube 60' will normally have a circular downstream end 62' to conform in shape to the throat thus contouring the shape of the stream of secondary fuel and air to the shape of the throat. The effect of this conical shape is to pattern the dimension of the stream to nearly fill the throat thereby more completely mixing the fuel with the products of combustion flowing from the primary zone.

Figure 5:
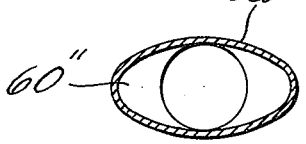
FIG. 5 is an end view of a modified form of the tube of FIG. 4.

The arrangement of FIG. 5 is usable especially in an annular burner where a ring of fuel nozzles supply fuel to the annular burner. In such a construction the throat is also annular. To spread the fuel and air stream from the tube 60'' more uniformly across the entire area of the annular throat the downstream end 62'' of the secondary fuel tube is a flat ellipse or oval shape with the major axis positioned in a tangential direction. This tube 60'' may be cylindrical as in FIG. 3 or may be tapered as in FIG. 4 to adjust the flow rate at the discharge end of the tube and to fit the shape of the stream to nearly fill the throat in a radial direction and also to better fill the circumferential dimension of the portion of the throat toward which the tube is directed.

Figure 6:
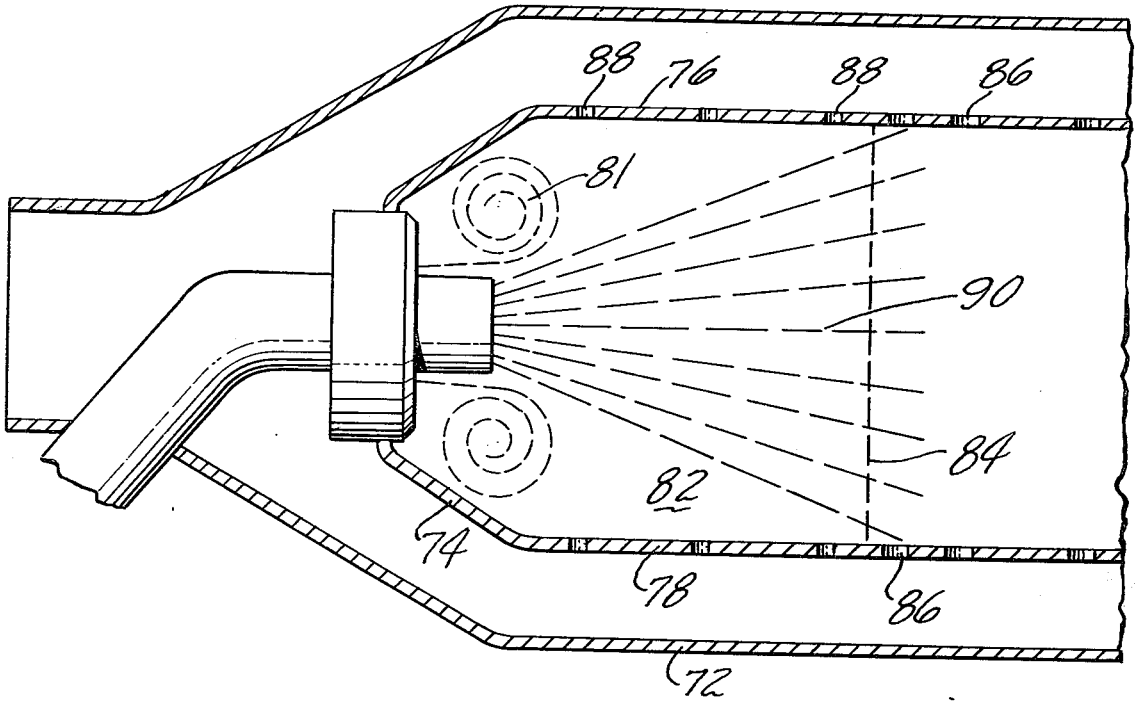
FIG. 6 is a view similar to FIG. 1 of a modified burner construction.

Although the invention is described in connection with a burner having a throat between the primary and secondary zones it is also applicable to a combustion chamber without a throat. As shown in FIG. 6, the combustion chamber duct 72, comparable to the duct 6 of FIG. 1, has a burner construction therein including an upstream end cap 74 and side walls 76 and 78 extending downstream therefrom in spaced relation to the duct. The arrangement shown is an annular burner construction in which the duct 72 is annular and the side walls 76 and 78 are concentric rings within the duct annulus.

Fuel nozzles are positioned in spaced relation to one another in the end cap, only one nozzle 80 being shown. This nozzle is similar to those above described. The primary nozzle creates a swirling torus shaped fuel and air mix 81 closely spaced from the end cap and the primary combustion occurs here in a primary zone 82. The downstream boundary for the primary zone is represented by a dotted line 84. This zone is structurally established in the burner by the air admission holes 86 in the walls 76 and 78 for the entry of air for secondary combustion. The primary zone terminates just upstream of these holes. Although the walls may have a row of smaller holes 88 near the end cap these serve only for a small addition of air into the primary combustion zone. The larger holes 86 provide for adequate air supply to mix with the secondary fuel and provide complete combustion. Thus the relatively narrow spray of fuel or fuel and air 90 from the secondary nozzle is established so as nearly to fill the cross section of the burner structure at or immediately before these holes 86 as these holes mark the beginning of the secondary combustion zone. Obviously the breadth of the spray discharge from the secondary nozzle is dependent upon the length of the burner from the end cap, or the end of the secondary nozzle to the air inlet holes 86. Thus, the nozzles above described are adapted for this form of burner construction. The primary combustion will be in a torus in the primary zone and the spray angle of the secondary fuel and air discharge from the secondary nozzle will be dimensioned so as to approximately fill the burner where these secondary air admission holes are located.

Although the nozzles have been described as primary and secondary nozzle it will be understood that the primary nozzle may be a pilot fuel nozzle for idle or very low power operation, with the secondary fuel being the main fuel to be varied for control of the engine over essentially the entire operative range. When the primary fuel is essentially for pilot purposes the dimensions of the primary and secondary combustion zones would be appropriately changed in proportion to the fuel delivered to each.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A burner construction including:

an inlet end cap having at least one central opening therein;

side walls extending downstream from the end cap and having openings therein, said walls converging in a downstream direction to form a throat spaced from the end cap, and diverging again downstream of the throat;

an annular nozzle in the opening in the end cap for directing fuel at a large angle relative to the axis of the burner to cause primary combustion in an annulus closely adjacent to the end cap; and a second nozzle within the annulus of the first nozzle directing fuel at a small angle and substantially parallel to the axis of the burner through the primary combustion, this small angle and the spacing of the throat from the end cap being such that substantially all the fuel from this nozzle passes through the throat without impingement on the converging walls for secondary combustion downstream of the throat.

2. A burner as in claim 1 in which the side walls have swirlers downstream of the throat to introduce swirling air for mixing with the fuel passing through the throat.

3. A burner as in claim 1 including a duct within which the end cap and side walls are located, the side walls being spaced from the walls of the duct for a flow of air therebetween.

4. A burner as in claim 1 in which the second nozzle discharges a mixture of fuel and air into the combustion space between the side walls.

5. A burner as in claim 1 in which the second nozzle extends beyond the first nozzle in a downstream direction to discharge fuel therefrom at a point spaced from the fuel from the first nozzle.

6. A burner as in claim 3 in which the duct has a diffuser at its inlet end, and the second nozzle receives air from the inlet end of the diffuser to mix with fuel in the nozzle.

7. A burner construction including:

a duct having a diffuser section at its inlet end;

a burner within the duct including an inlet end cap adjacent to the diffuser section of the duct and side walls extending downstream in the duct from the end cap in spaced relation to the walls of the duct, said side walls converging downstream of the end cap to form a throat and to define a primary combustion chamber between the end cap and the throat, said side walls diverging downstream of the throat to form at this point a secondary combustion chamber;

an annular nozzle carried by said end cap and discharging fuel at a large angle relative to the longitudinal axis of the burner to mix with air in the burner close to the end cap for combustion in an annulus in said primary chamber, said cap and side walls having openings therein for the entry of air to the burner to support combustion therein; and a second nozzle within the annulus of the first nozzle for directing fuel through the primary zone substantially parallel to the walls of the burner and at a small angle into and through the throat for combustion in the secondary chamber.

8. A burner construction as in claim 7 in which the first nozzle includes air swirlers for imparting a swirl to air to mix this air with the fuel as it is sprayed into the primary chamber.

9. A burner construction as in claim 7 in which the second nozzle includes a tube extending to a point within the primary chamber downstream of the first nozzle for discharge of the fuel at a point closer to the throat.

10. A burner construction as in claim 9 in which the tube flares toward the end to define the angle of the discharge of fuel therefrom.

* * * * *